US012366364B2

(12) United States Patent
Giramallanavar et al.

(10) Patent No.: US 12,366,364 B2
(45) Date of Patent: Jul. 22, 2025

(54) BOTTOM VENT TRIM FOR OVEN

(71) Applicant: WHIRLPOOL CORPORATION, Benton Harbor, MI (US)

(72) Inventors: Shivaraj V. Giramallanavar, Belagavi (IN); Ankur Garg, Pune (IN); Avinash Nanjundappa, Bangalore (IN); David G. Quante, St. Joseph, MI (US); Federico Garuccio, Bresso (IT); Ashish Mittal, Pune (IN)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 902 days.

(21) Appl. No.: 17/540,390

(22) Filed: Dec. 2, 2021

(65) Prior Publication Data

US 2023/0175700 A1 Jun. 8, 2023

(51) Int. Cl.
*F24C 15/00* (2006.01)
*F24C 15/30* (2006.01)

(52) U.S. Cl.
CPC ..... *F24C 15/006* (2013.01); *F24C 15/30* (2013.01)

(58) Field of Classification Search
CPC ..... F24C 15/006; F24C 15/30; F24C 15/322
USPC ..... 126/19 R, 273 A, 273 R, 273.5, 275 R, 126/275 E, 2 A; 454/289; 219/757
See application file for complete search history.

(56) References Cited

U.S. PATENT DOCUMENTS 1,438,434 A * 12/1922 Forgy ..... F24B 1/20 126/39 C
2,662,747 A * 12/1953 Trane ..... F24D 19/04 165/96
2,771,833 A * 11/1956 Halliday ..... F24F 13/072 454/288
3,180,462 A 4/1965 Grady
3,334,621 A * 8/1967 Britt ..... F24F 13/075 126/299 R
3,488,475 A * 1/1970 Gronwoldt ..... F24H 3/002 338/238
3,889,100 A * 6/1975 Dills ..... F24C 15/006 219/393
3,924,601 A * 12/1975 Nuss ..... F24C 15/006 126/21 R
4,180,049 A * 12/1979 Carr ..... H05B 6/642 219/400
4,327,274 A 4/1982 White et al.
(Continued)

FOREIGN PATENT DOCUMENTS

DE 8623856 11/1986
EP 0474581 3/1992
(Continued)

OTHER PUBLICATIONS

Whirlpool Corp., "Installation Instructions 27" (68.6 cm) and 30' (76.2 cm) Electric Single and Double Built-In Oven, Instructions D'Installation Four Electrique Encastre 27" (68,6 cm) et 30" (76,2 cm)—Simple et Double" (2014).

*Primary Examiner* — Vivek K Shirsat
(74) *Attorney, Agent, or Firm* — PRICE HENEVELD LLP

(57) ABSTRACT

A vent assembly for use with an oven. The vent assembly includes polymeric end caps that are ultrasonically molded to a metal bracket. The metal bracket is coupled to a lower fin and an upper fin. The polymeric end caps include support surfaces for holding sections of the lower fin, the upper fin, and the metal bracket.

20 Claims, 13 Drawing Sheets

(56) References Cited

U.S. PATENT DOCUMENTS 4,592,333 A * 6/1986 Dustin ..... F24C 15/2014 126/299 R
4,796,600 A * 1/1989 Hurley ..... F24C 14/025 126/21 R
4,899,028 A * 2/1990 Arai ..... H05B 6/1263 126/299 D
4,935,593 A * 6/1990 Nishikawa ..... F24C 15/02 219/722
5,562,090 A 10/1996 Katz
5,819,722 A * 10/1998 Katz ..... F24C 15/006 126/200
6,085,985 A * 7/2000 LaSelva ..... F24D 19/06 237/79
6,098,613 A * 8/2000 Wiersma ..... F24C 15/2007 126/21 R
6,211,504 B1 * 4/2001 Lee ..... H05B 6/6423 219/718
6,291,809 B1 * 9/2001 Ha ..... H05B 6/6423 219/757
6,512,214 B2 * 1/2003 Jeong ..... H05B 6/6429 248/339
6,586,716 B1 * 7/2003 Lee ..... H05B 6/6429 219/757
6,717,123 B1 * 4/2004 Kim ..... H05B 6/6429 219/757
6,734,408 B2 * 5/2004 Shin ..... H05B 6/6429 219/757
7,640,930 B2 1/2010 Little et al.
8,066,000 B2 11/2011 Tsakiris
10,288,298 B2 5/2019 Chadwick et al.
10,309,657 B2 * 6/2019 Trice ..... F24C 3/027
12,234,998 B1 * 2/2025 Fratianne ..... F24D 19/04
2002/0050491 A1 * 5/2002 Kim ..... H05B 6/6429 219/757
2003/0037780 A1 * 2/2003 Wiersma ..... F24C 3/087 126/21 R
2003/0230396 A1 * 12/2003 Weintraub ..... F24D 19/04 165/181
2005/0078952 A1 * 4/2005 Bain ..... F24H 3/0411 392/360
2007/0267402 A1 * 11/2007 Harned ..... F24C 15/026 219/408
2009/0085713 A1 * 4/2009 Tsang ..... F24H 3/002 392/374
2009/0173333 A1 * 7/2009 Kwon ..... F24C 3/067 126/39 E
2010/0300427 A1 * 12/2010 Kwon ..... F24C 15/006 126/39 R
2015/0260415 A1 * 9/2015 Chadwick ..... F24C 15/2007 126/21 R
2016/0033143 A1 * 2/2016 Lee ..... F24C 15/006 126/198
2018/0003389 A1 * 1/2018 Trice ..... F24C 15/32
2019/0145627 A1 * 5/2019 Johnson ..... F24C 15/006 126/21 R
2020/0232674 A1 7/2020 Dib et al.
2022/0082266 A1 * 3/2022 Perugu ..... F24C 15/2014
2022/0221158 A1 * 7/2022 Jang ..... F24C 15/006
2022/0221162 A1 * 7/2022 Feng ..... F24C 15/30
2022/0316712 A1 * 10/2022 Bhosale ..... F24C 15/023
2023/0175700 A1 * 6/2023 Giramallanavar ..... F24C 15/30 126/19 R
2024/0179389 A1 * 5/2024 Bentley ..... F24C 15/006

FOREIGN PATENT DOCUMENTS

IT PD20070064 8/2008
JP S59151008 10/1984
KR 20080062782 7/2008

* cited by examiner

BOTTOM VENT TRIM FOR OVEN

BACKGROUND OF THE DISCLOSURE

The present disclosure generally relates to ventilation for an oven, and more specifically, to a bottom vent that has a smaller, more durable profile.

Vents can be used to release exhaust air from the oven cooking system as well as exhaust from the cooking cavity of the oven. Vents can also be used to reduce or prevent the mixing of the exhausted hot air and the air entering into the inlets of the oven door. Bottom vents are particularly useful for releasing exhaust from underneath the door of the oven. However, bottom vents can be damaged during installation and/or servicing of the oven, particularly when the bottom front surface of the vent is positioned close to or adjacent a wall, cabinet, floor, or other surface. Thus, a bottom vent with a smaller, more durable design would reduce the chances of damage to the bottom vent during installation and/or servicing of the oven.

SUMMARY OF THE DISCLOSURE

One aspect of the present invention is a wall oven with a bottom vent assembly. The wall oven includes a housing defining a cooking cavity with a door coupled to the front of the housing. The bottom vent assembly is coupled to the front of the housing below the door. The vent assembly has an upper fin and a lower fin with a plurality of slots. The vent assembly also includes a metal bracket that has a top surface, a side surface that is generally perpendicular to the top surface, and a flange that extends laterally from the side surface. The metal bracket includes at least one first top opening in the top surface and at least one side opening in the side surface. The vent assembly includes a polymeric end cap with at least one projection that is ultrasonically welded to the at least one side opening of the metal bracket. The polymeric end cap includes support surfaces for the upper fin and the lower fin. One or more fastener members couple the opening 10 in the upper fin to the opening(s) in the top surface of the metal bracket.

Another aspect of the present invention is a vent assembly for an oven. The vent assembly has an upper fin and a lower fin with a plurality of slots. The vent assembly includes a metal bracket that has a top surface, a side surface that is generally perpendicular to the top surface, and a flange that extends laterally from the side surface. There is at least one opening in the top surface and at least one opening in the side surface of the metal bracket. The vent assembly includes a polymeric end cap with at least one projection that is ultrasonically welded to the at least one side opening of the metal bracket. The polymeric end cap also includes support surfaces for the upper fin and lower fin. At least one fastening member couples at least one opening in the upper fin to the opening(s) in the top surface of the metal bracket.

Yet another aspect of the present invention is a cooking appliance with a bottom vent assembly. The appliance has a housing defining the cooking cavity and a vent assembly is coupled to the appliance below the cooking cavity. The vent assembly has an upper fin and a lower fin with a plurality of slots. The vent assembly includes a metal bracket having a top surface, a side surface that is generally perpendicular to the top surface, and a flange that extends laterally from the side surface. The metal bracket includes at least one opening in the top surface and at least one opening in the side surface of the metal bracket. The vent assembly includes a polymeric end cap with at least one projection that is ultrasonically welded to the side opening(s) of the metal bracket. The polymeric end cap includes support surfaces for the upper fin and lower fin. At least one fastening member couples at least one opening in the upper fin to at least one opening in the top surface of the metal bracket.

These and other features, advantages, and objects of the present disclosure will be further understood and appreciated by those skilled in the art by reference to the following specification, claims, and appended drawings.

Figure 1:
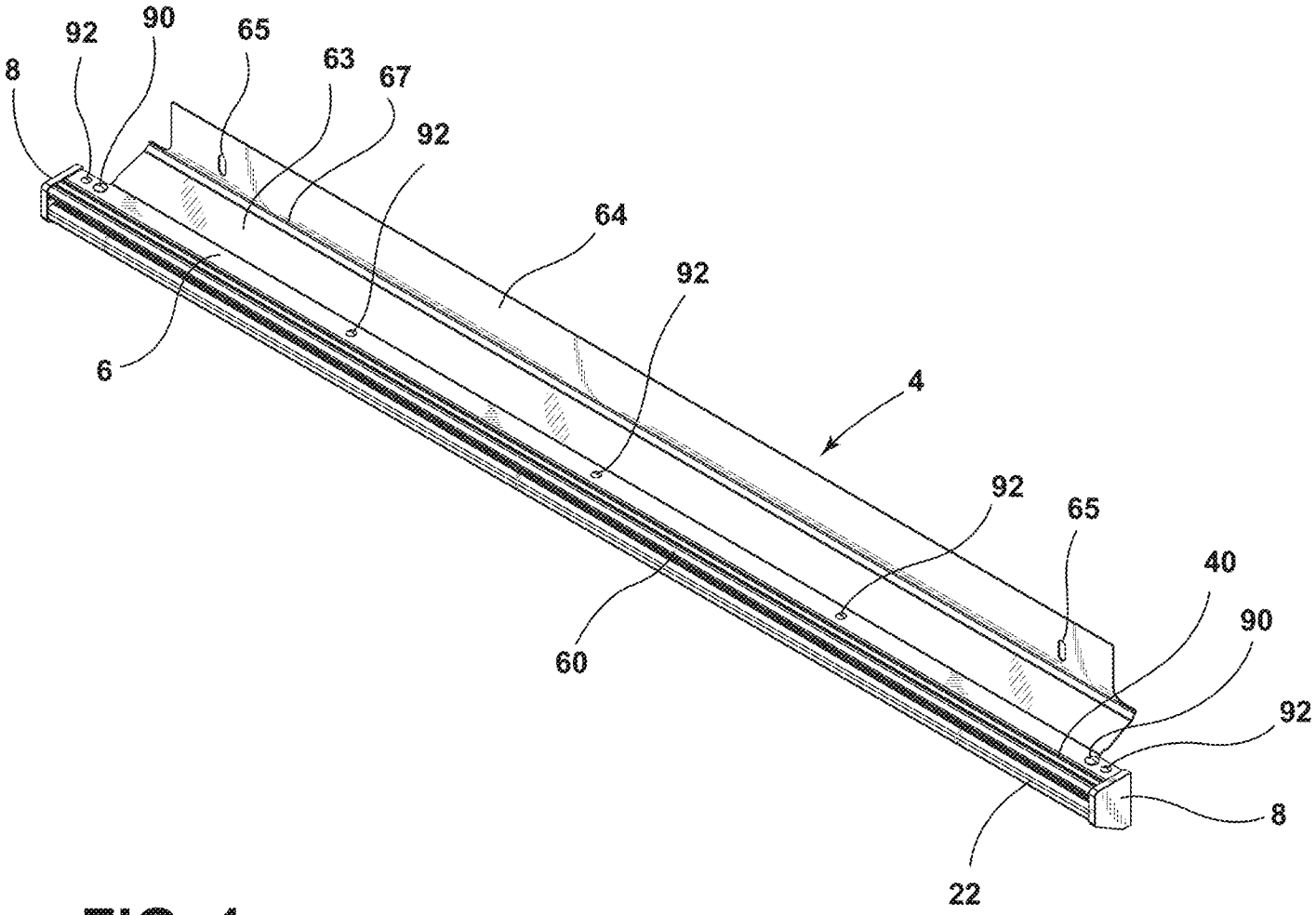
FIG. 1 is a top perspective view of a vent assembly.
Figure 2:
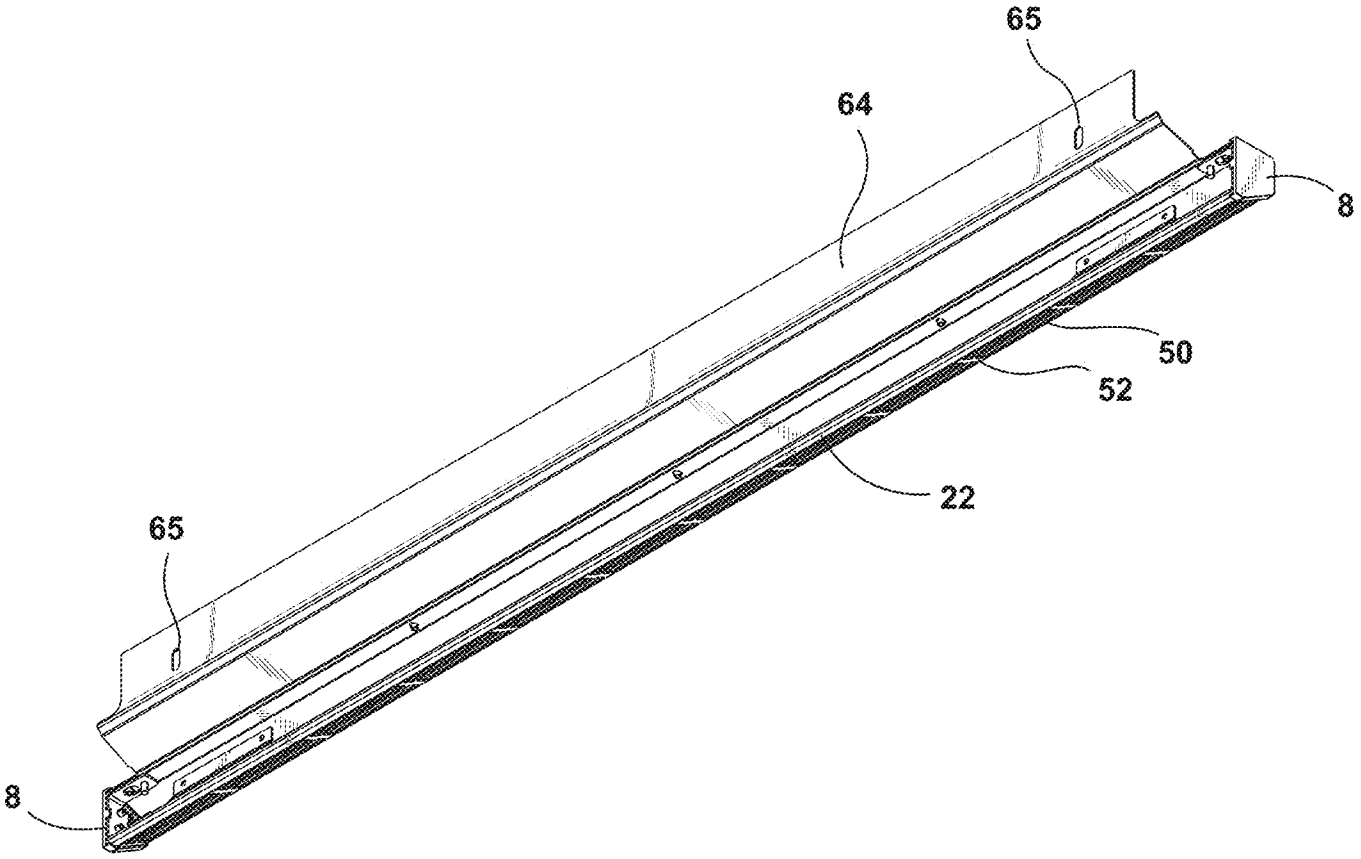
FIG. 2 is a bottom perspective view of the vent assembly shown in FIG. 1.
Figure 3:
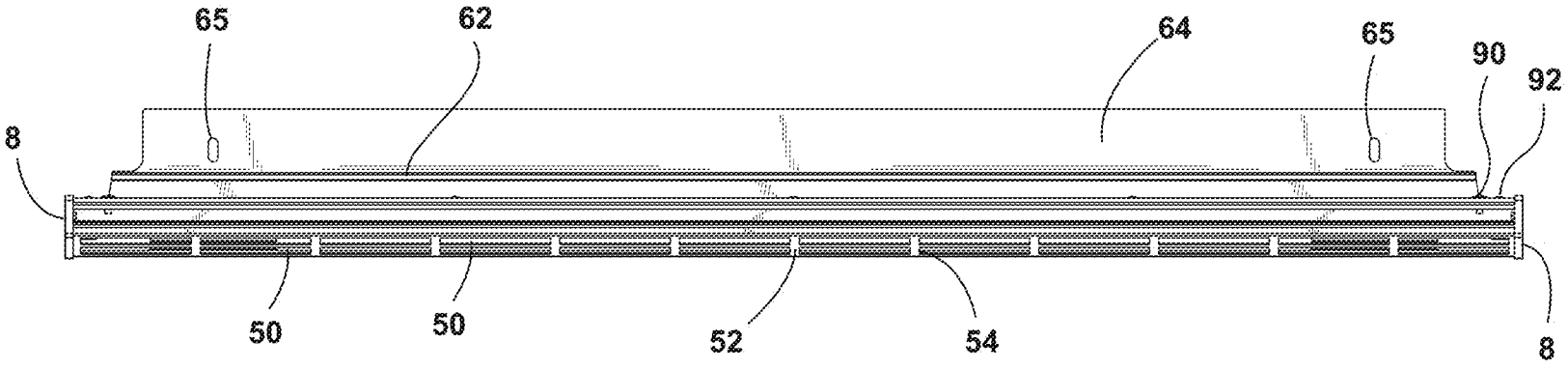
FIG. 3 is a front elevational view of the vent assembly shown in FIG. 1.
Figure 4:
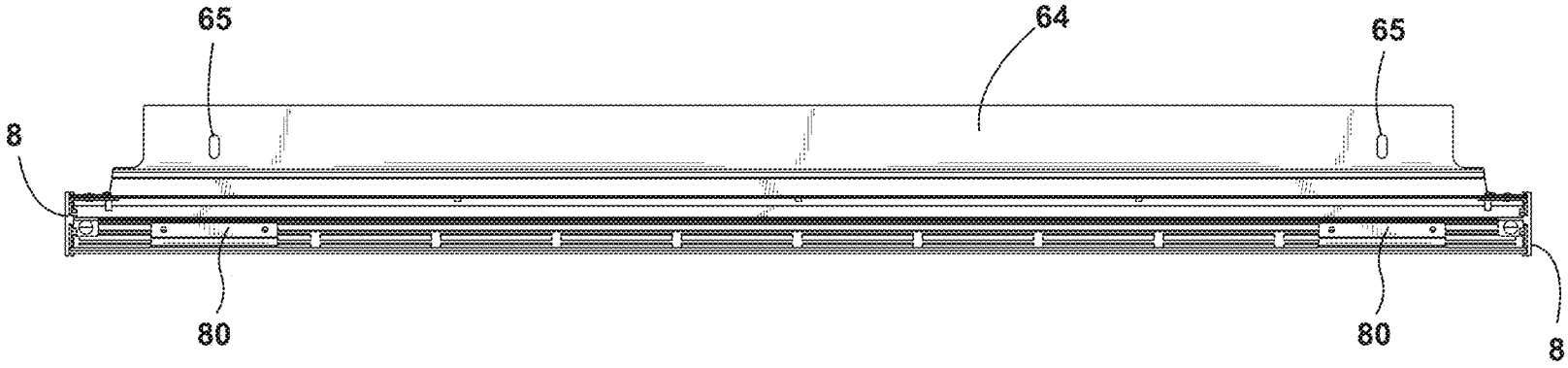
FIG. 4 is a back elevational view of the vent assembly shown in FIG. 1.

The components in the figures are not necessarily to scale, emphasis instead being placed upon illustrating the principles described herein.

DETAILED DESCRIPTION

The present illustrated embodiments reside primarily in combinations of method steps and apparatus components related to a bottom vent assembly for an oven. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Figure 17:
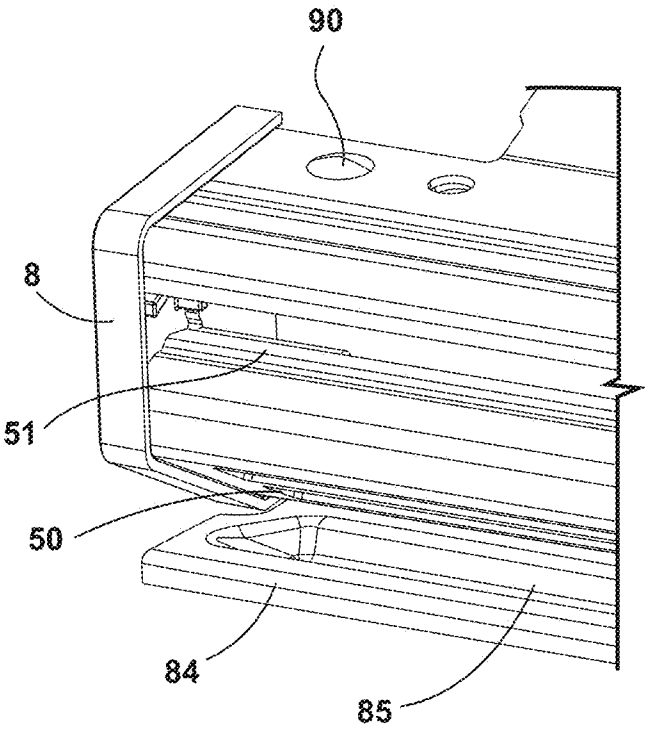
FIG. 17 is a partial front perspective view of the vent assembly shown in FIG. 16.
Figure 18:
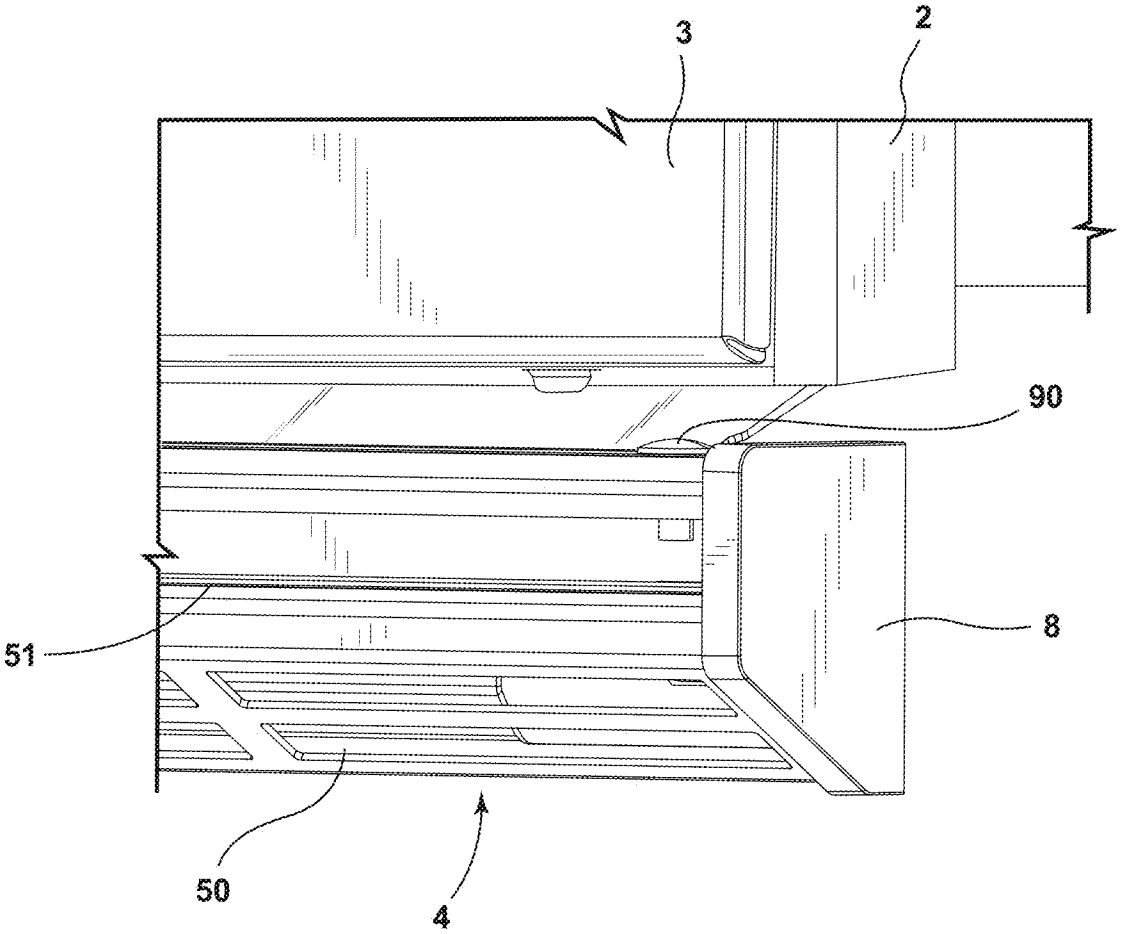
FIG. 18 is a partial front perspective view of the vent assembly shown in FIG. 1 installed in an oven.

Vent assembly 4 is illustrated in FIGS. 1-18. The vent assembly 4 is used as a bottom vent to an oven 2 by being positioned below oven door 3, as illustrated in FIG. 18. The oven door 3 can include one or more cooling air intake inlets. The intake inlets can be positioned adjacent to the vent assembly 4. For example, the intake inlets can be positioned on the lower surface and/or the lower side surfaces of oven door 3. The vent assembly 4 includes an upper fin 6, a pair of end caps 8, a pair of brackets 10, and a lower fin 22. The vent assembly 4 can also include a deflector 84 that is positioned below the lower fin 22 as illustrated in FIGS. 16 and 17.

Figure 6:
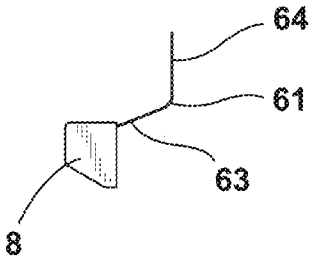
FIG. 6 is a right side elevational view of the vent assembly shown in FIG. 1.
Figure 5:
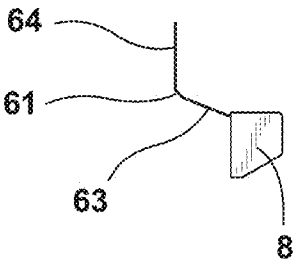
FIG. 5 is a left side elevational view of the vent assembly shown in FIG. 1.
Figure 7:
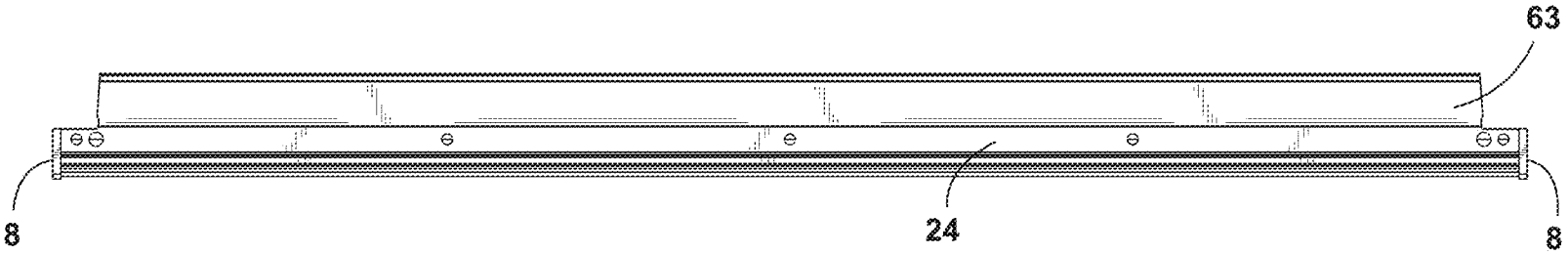
FIG. 7 is a top elevational view of the vent assembly shown in FIG. 1.
Figure 8:
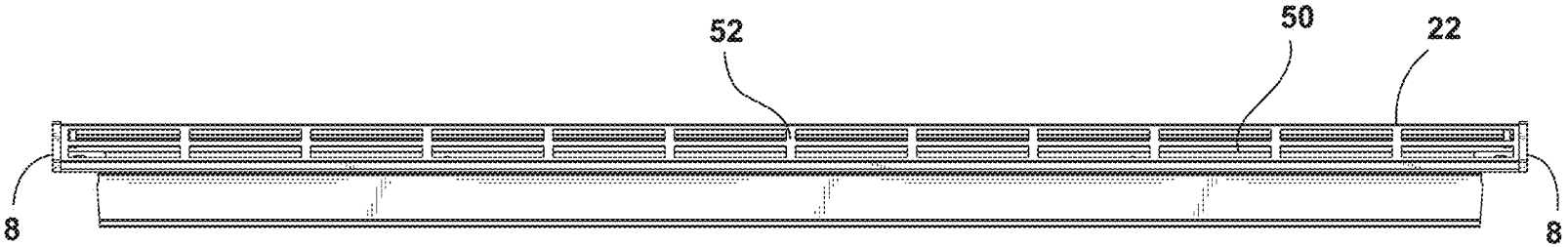
FIG. 8 is a bottom elevational view of the vent assembly shown in FIG. 1.

The upper fin 6 also includes a flange 62 that is used for installing the vent assembly 4 to the oven 2. The flange 62 includes an upper portion 64 that includes one or more slots 65 for securing the flange 62 to the oven 2 using a fastener (not shown). The flange 62 also includes an angled section 63 that transitions to the upper portion 64 at bend 61, as illustrated in FIGS. 5 and 6.

Figure 9:
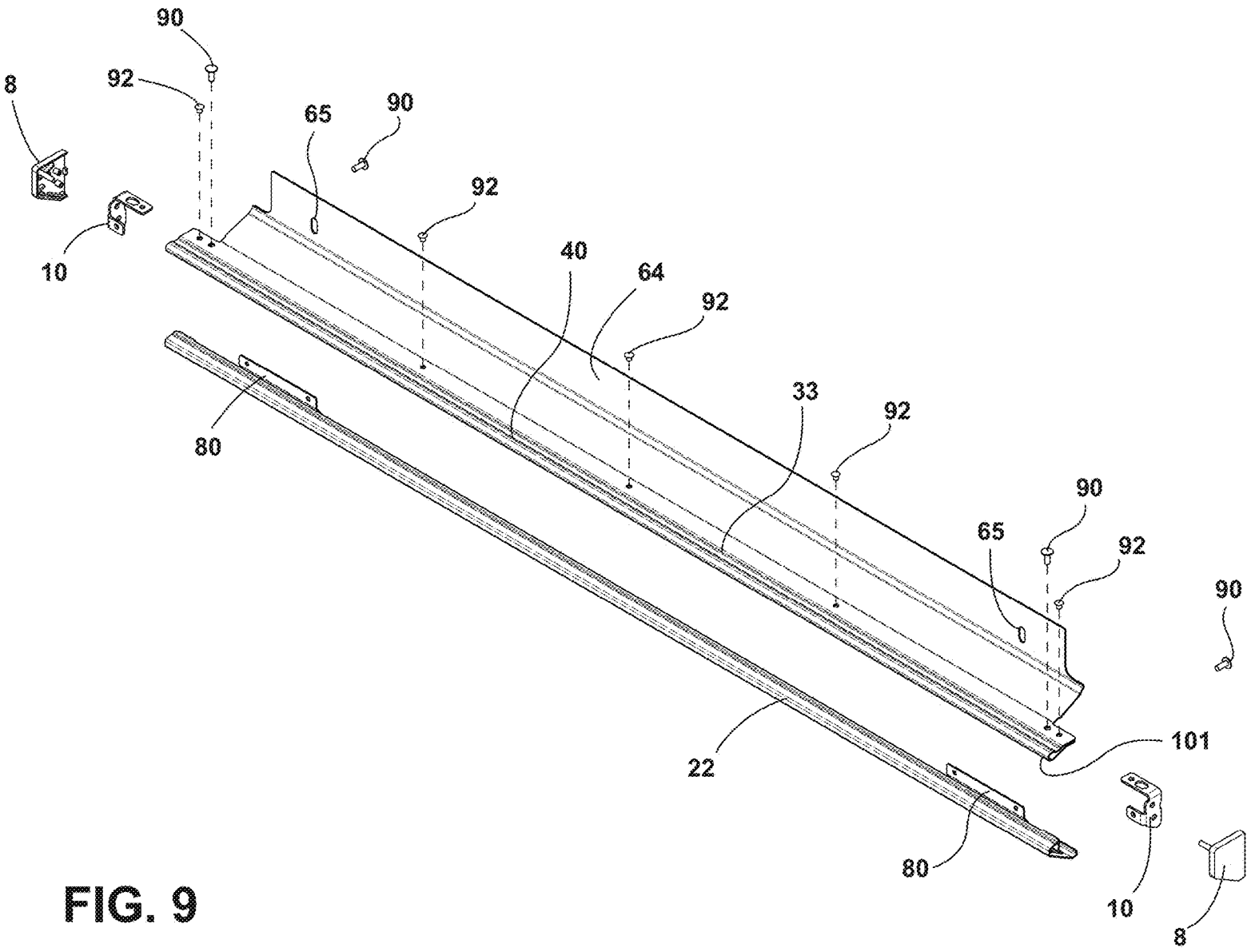
FIG. 9 is a top perspective view of the components for the vent assembly shown in FIG. 1.
Figure 10:
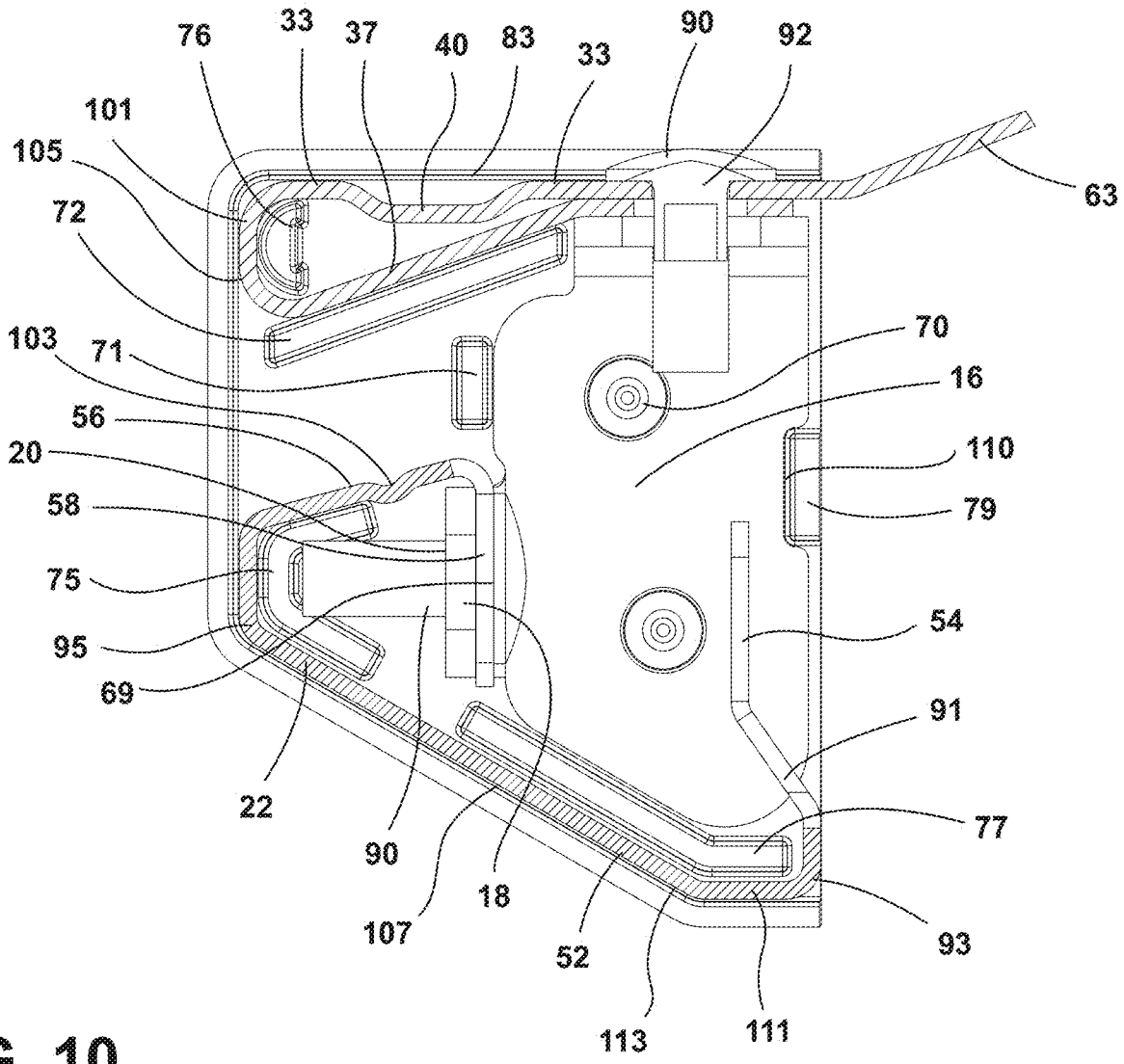
FIG. 10 is a cross-sectional view of the vent assembly shown in FIG. 1.
Figure 11:
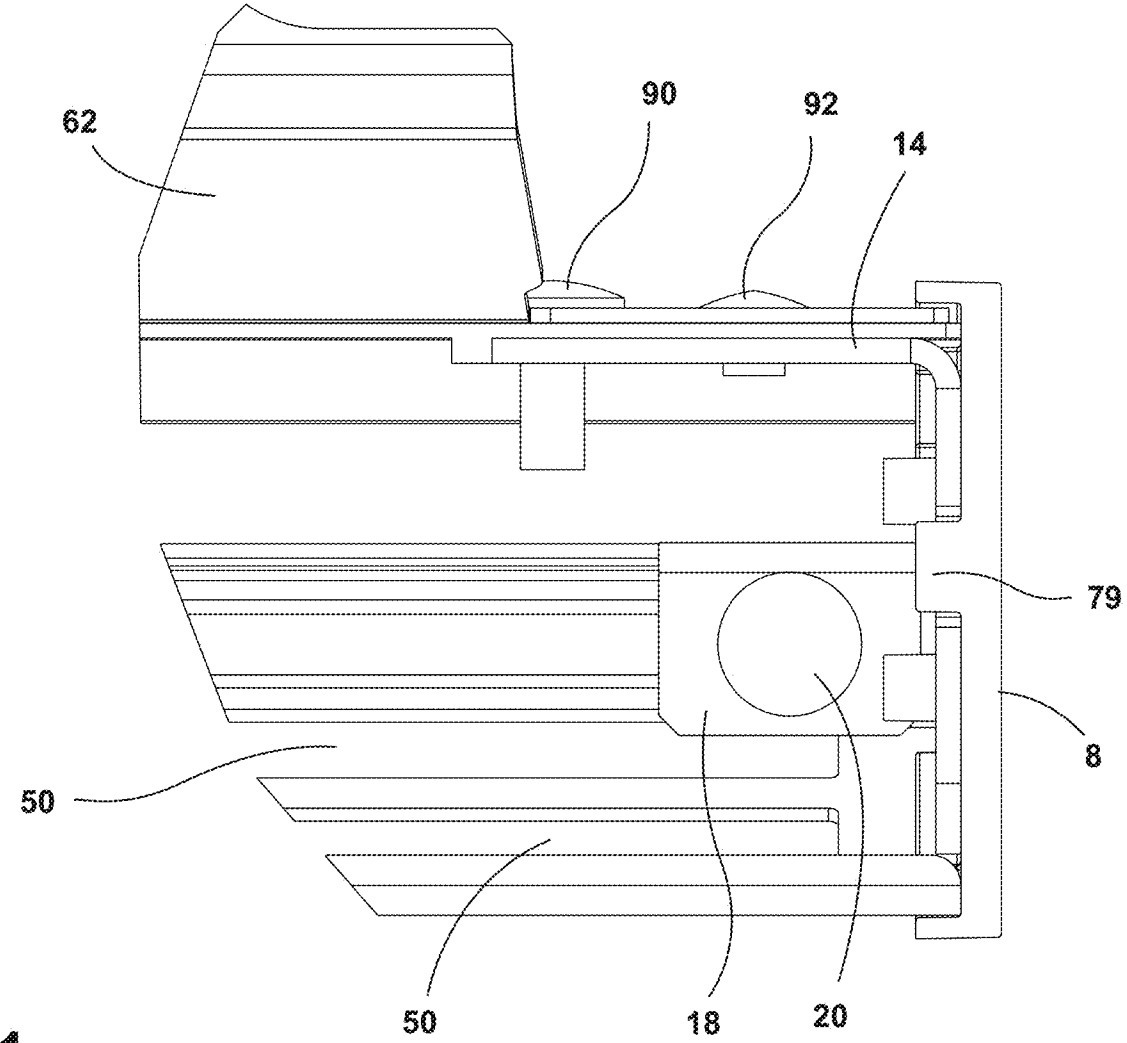
FIG. 11 is a partial rear perspective view of the vent assembly shown in FIG. 1.

The upper fin 6 also includes a top surface 33 that is illustrated as having a groove 40, as shown in FIGS. 9 and 10. The groove 40 can be slotted and can collect condensed liquid droplets that fall in the groove 40 and can enter the slots to evaporate. This reduces the chances of liquid droplets falling onto the surface supporting the oven. The upper fin 6 includes a front curved portion 101 that transitions from the top surface 33 to an angled surface 37, as illustrated in FIG. 10. The upper fin 6 can be made from any suitable material. In the illustrated embodiment, upper fin 6 is a piece of roll-formed metal.

Figure 14:
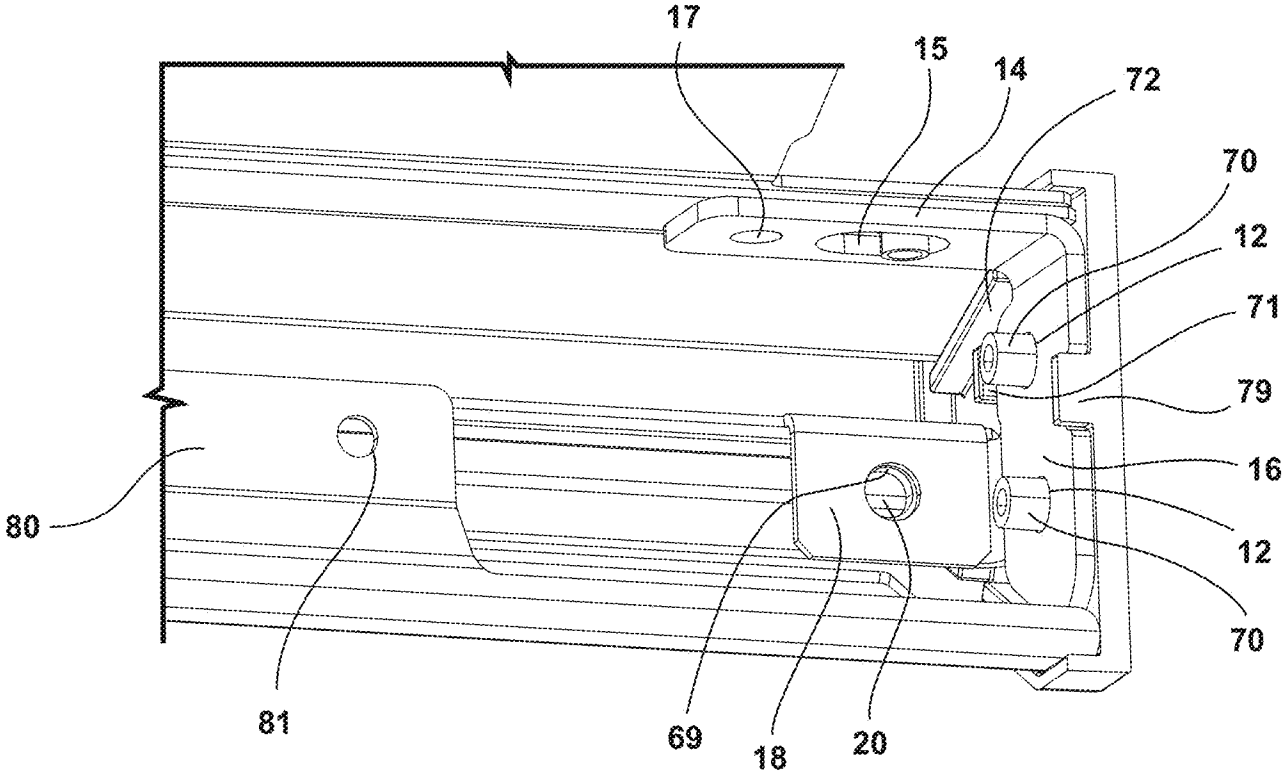
FIG. 14 is a partial back perspective view of the vent assembly shown in FIG. 1.

The lower fin 22 has an angled face 52 with a plurality of slots 50, as shown in FIGS. 3, 4, 8, and 16-18. The lower fin 22 includes a rear vertical member 54 that extends from a rear angled portion 91. The face 52 of the lower fin 22 extends from the curved transition point 93 from the rear angled portion 91, as illustrated in FIG. 10. A generally horizontal rear section 111 extends between the transition point 93 and the face 52. A generally vertical front section 95 extends upward from the face 52, as illustrated in FIG. 10. An angled horizontal extension 56 extends upward from front section 95 transitioning to a downward extension 58, as illustrated in FIG. 10. A groove 103 can be formed in the angled horizontal section 56 to help secure the lower fin 22 to the end cap 8 by contacting a surface of the front lower fin support 75. The lower fin 22 can include one or more bracket extensions 80 with openings 81, as illustrated in FIG. 14. These bracket extensions 80 can help couple the lower fin 22 to a surface of oven 2. The lower fin 22 can be made from any suitable material. In the illustrated embodiment, lower fin 22 is a stamped piece of metal.

The bracket 10 includes a top surface 14, a side surface 16, and a flange section 18. In the illustrated embodiment, the top surface 14 is perpendicular to the side surface 16, while the flange 18 extends laterally from the side surface 16. Top surface 14 includes two openings, as illustrated in FIG. 14, one larger opening 15 and one smaller opening 17. The side surface 16 is illustrated as having two openings 12 and the flange 18 is illustrated as having a single opening 20, again as illustrated in FIG. 14. The location, size, and number of openings on the top surface 14, side surface 16, and flange 18 can vary from what is illustrated in FIG. 14. The bracket 10 is made from a metal material, such as a piece of sheet metal.

The end caps 8 include two projections 70 that are received within the openings 12 in the side surface 16 of bracket 10. The projections 70 are ultrasonically welded into the openings 12 in bracket 10. While the illustrated embodiments illustrate two projections 70 that are generally cylindrical, the projections 70 can be of any shape that can be ultrasonically welded into corresponding openings 12 in the bracket 10. In addition, any number of projections 70 can be used, and the spacing and the size and shape of individual projections 70 can be varied. The end caps 8 also include a number of surfaces that are designed to support and engage surfaces of the upper fin 6 and the lower fin 22. For example, the end cap 8 can include an angled upper fin support 72 that supports the angled surface 37 of the upper fin 6, and a curved upper fin support 76 that engages the front curved portion 101 of the upper fin 6. In addition, the inside top surface 33 of the upper fin 6 can engage the inside upper surface 83 of the end cap 8. The inside front surface 105 of the end cap 8 can also engage the front curved portion 101 of the upper fin 6 such that the front curved portion 101 is in between front surface 105 and 76 of the end cap 8.

The end cap 8 includes lower fin supports 75, 77, as illustrated in FIG. 10. Rear lower fin support 77 can include a generally horizontal section and an angled section. The face 52 and the rear section 111 of the lower fin 22 can be positioned in between the rear lower fin support 77 and the lower inside surface 113 of the end cap 8. The front lower fin support 75 can include a generally vertical section that is in between two angled sections. A portion of the face 52, front surface 95, and angled horizontal section 56 of the lower fin 22 is in between the front lower fin support 75 and the inside front surface 105 and lower inside surface 113 of the end cap 8. End cap 8 can also include a rear tab 79 that contacts a groove 110 in the metal bracket 10 and a front tab 71 that contacts the metal bracket 10, as illustrated in FIG. 10. The end cap 8 is made from a flexible polymeric material such that it is capable of deforming and bending back into its original shape. The side surface 16 of the metal bracket 10 can also contact the rear lower fin support 77 of the end cap 8.

Figure 13:
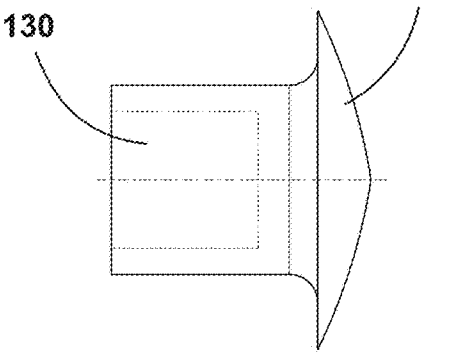
FIG. 13 is a side partial cross-sectional view of another fastener used in the vent assembly shown in FIG. 1.
Figure 12:
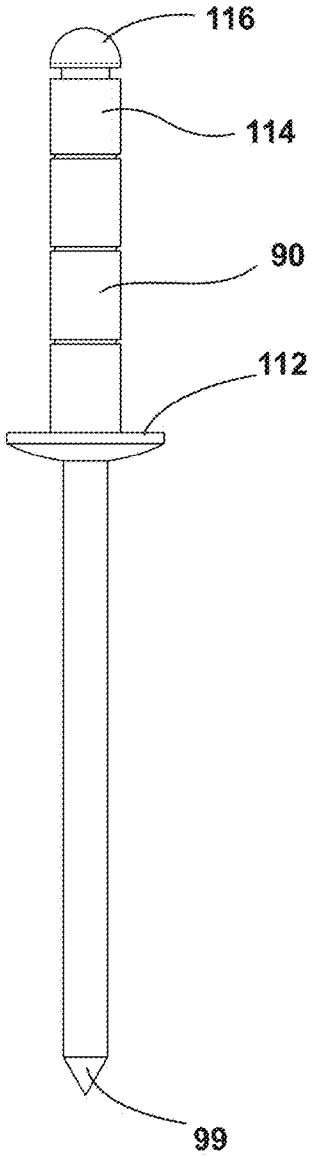
FIG. 12 is a front perspective view of one fastener used in the vent assembly shown in FIG. 1.

In the illustrated embodiment, two different types of fasteners are used in connecting the components of the vent assembly 4. A long rivet 90 can include end portion 116 that can be generally round. The long rivet 90 can include a number of segments 114, as illustrated in FIG. 12. The cap 112 of the long rivet 90 will remain once the section 99 is removed and the long rivet 90 is installed, drawing the segments 114 and end portion 116 together as the section 99 is removed. A second fastener, namely, cap 92 is illustrated in FIG. 13. The cap 92 can include a hollow interior surface 130.

The fasteners 90, 92 can be used to couple the openings in bracket 10 to the openings in lower fin 22 and upper fin 6, as illustrated in FIGS. 4 and 9-11. For example, the opening 20 in flange 18 and the opening 69 in the lower fin 22 are aligned and secured with a fastener.

Figure 15:
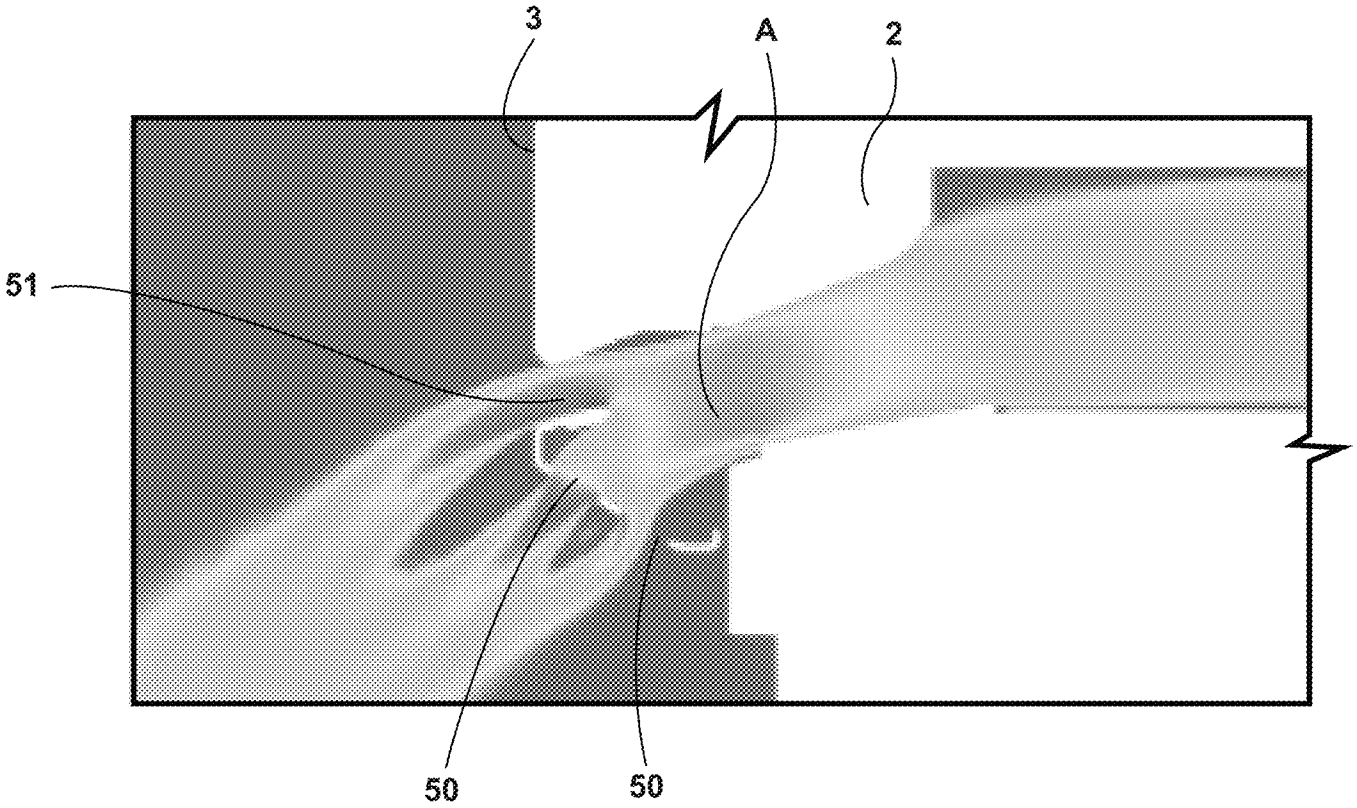
FIG. 15 is a partial side cross-sectional perspective that illustrates the flow of air from an oven cavity through the vent assembly shown in FIG. 1.
Figure 16:
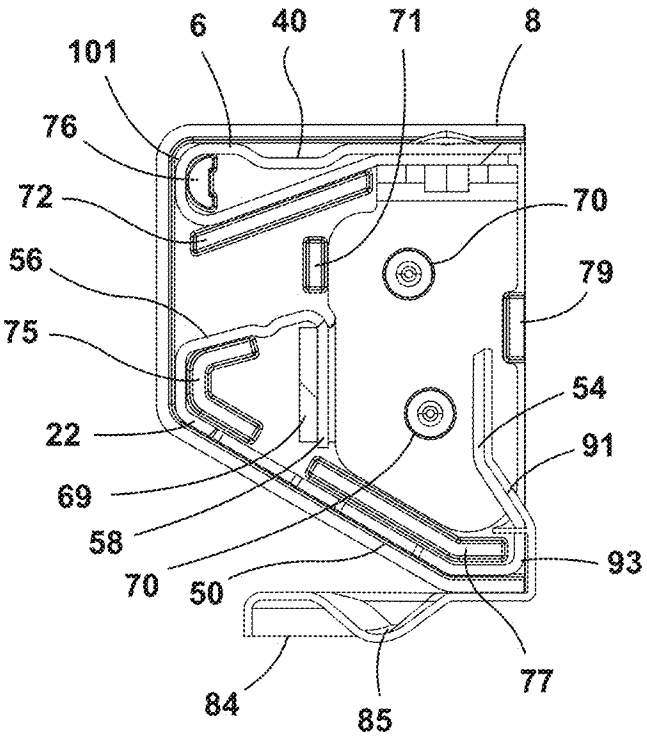
FIG. 16 is a side cross-sectional view of another embodiment of a vent assembly that has an additional deflector.

FIG. 15 illustrates the air flow A through the slots 50 in lower fin 22 and the gap 51 between the upper fin 6 and lower fin 22. The vent assembly 4 can also include a deflector 84 that includes a groove 85 positioned below one or more of the slots 50 in the face 52 of the lower fin 22, as illustrated in FIGS. 16 and 17. The deflector 84 serves to deflect and disperse the downward trajectory of the air flow A from the vent assembly 4. The geometry of the vent assembly 4 is designed to direct hot exhaust air flow A away from the appliance and to reduce or eliminate the intake of exhausted hot air into the cooling air intake of the appliance.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A wall oven with a bottom vent assembly, comprising:
a wall oven including a housing defining a cooking cavity;
a door coupled to the front of said housing;
a vent assembly coupled to the front of said housing below said door, comprising:
an upper fin;
a lower fin with a plurality of slots;
a metal bracket having a top surface, a side surface that is generally perpendicular to said top surface, and a flange that extends laterally from said side surface;
wherein said top surface includes at least one first top opening;
wherein said side surface includes at least one side opening;
a polymeric end cap with at least one projection that is ultrasonically welded to said at least one side opening of said metal bracket;
wherein said polymeric end cap includes support surfaces for said upper fin and said lower fin; and
wherein at least one fastening member couples at least one opening in said upper fin to said at least one first top opening in said top surface of said metal bracket.

2. The wall oven with a bottom vent assembly of claim 1, wherein said polymeric end cap has a pair of projections that are ultrasonically welded to a pair of side openings in said side surface of said metal bracket.

3. The wall oven with a bottom vent assembly of claim 1, wherein said flange of said metal bracket includes an opening that couples to an opening on a tab on said lower fin using a fastener.

4. The wall oven with a bottom vent assembly of claim 1, wherein said polymeric end cap includes a rear lower fin support surface that includes a generally horizontal portion and a generally angled portion that is positioned generally parallel to a portion of the outer surface of said polymeric cap to surround the generally horizontal portion and the generally angled portion of the lower fin.

5. The wall oven with a bottom vent assembly of claim 4, wherein said polymeric end cap includes a front lower fin support surface that includes a generally vertical middle section with angled sections extending off of the top and bottom of said middle section.

6. The wall oven with a bottom vent assembly of claim 1, further including a deflector having at least one deflecting surface positioned below said plurality of slots in said lower fin.

7. The wall oven with a bottom vent assembly of claim 1, wherein said door includes a plurality of air inlets that are positioned on said door in close proximity to said vent assembly.

8. A vent assembly for an oven, comprising:
an upper fin;
a lower fin with a plurality of slots;
a metal bracket having a top surface, a side surface that is generally perpendicular to said top surface, and a flange that extends laterally from said side surface;

wherein said top surface includes at least one first top opening;

wherein said side surface includes at least one side opening;

a polymeric end cap with at least one projection that is ultrasonically welded to said at least one side opening of said metal bracket;

wherein said polymeric end cap includes support surfaces for said upper fin and said lower fin; and wherein at least one fastening member couples at least one opening in said upper fin to said at least one first top opening in said top surface of said metal bracket.

9. The vent assembly of claim 8, wherein said polymeric end cap has a pair of projections that are ultrasonically welded to a pair of side openings in said side surface of said metal bracket.

10. The vent assembly of claim 8, wherein said flange of said metal bracket includes an opening that couples to an opening on a tab on said lower fin using a fastener.

11. The vent assembly of claim 8, wherein said polymeric end cap includes a rear lower fin support surface that includes a generally horizontal portion and a generally angled portion that is positioned generally parallel to a portion of the outer surface of said polymeric cap to surround the generally horizontal portion and the generally angled portion of the lower fin.

12. The vent assembly of claim 8, wherein said polymeric end cap includes a front lower fin support surface that includes a generally vertical middle section with angled sections extending off of the top and bottom of said middle section.

13. The vent assembly of claim 8, further including a deflector having at least one deflecting surface positioned below said plurality of slots in said lower fin.

14. The vent assembly of claim 8, further including a slotted surface on a top surface of said upper fin.

15. A cooking appliance with a bottom vent assembly, comprising:

an appliance having a housing defining a cooking cavity;

a vent assembly coupled to the appliance below said cooking cavity, comprising:

an upper fin;

a lower fin with a plurality of slots;

a metal bracket having a top surface, a side surface that is generally perpendicular to said top surface, and a flange that extends laterally from said side surface;

wherein said top surface includes at least one first top opening;

wherein said side surface includes at least one side opening;

a polymeric end cap with at least one projection that is ultrasonically welded to said at least one side opening of said metal bracket;

wherein said polymeric end cap includes support surfaces for said upper fin and said lower fin; and wherein at least one fastening member couples at least one opening in said upper fin to said at least one first top opening in said top surface of said metal bracket.

16. The cooking appliance of claim 15, wherein said polymeric end cap has a pair of projections that are ultrasonically welded to a pair of side openings in said side surface of said metal bracket.

17. The cooking appliance of claim 15, wherein said flange of said metal bracket includes an opening that couples to an opening on a tab on said lower fin using a fastener.

18. The cooking appliance of claim 15, wherein said polymeric end cap includes a rear lower fin support surface that includes a generally horizontal portion and a generally angled portion that is positioned generally parallel to a portion of the outer surface of said polymeric cap to surround the generally horizontal portion and the generally angled portion of the lower fin.

19. The cooking appliance of claim 15, wherein said polymeric end cap includes a front lower fin support surface that includes a generally vertical middle section with angled sections extending off of the top and bottom of said middle section.

20. The cooking appliance of claim 15, further including a deflector having at least one deflecting surface positioned below said plurality of slots in said lower fin.

* * * * *